US006421026B2

(12) United States Patent
Nishino et al.

(10) Patent No.: US 6,421,026 B2
(45) Date of Patent: Jul. 16, 2002

(54) ANTENNA DEVICE PROVIDED WITH MATCHING CIRCUITS ADAPTED FOR REFLECTION COEFFICIENTS

(75) Inventors: Tamotsu Nishino; Moriyasu Miyazaki; Tsutomu Endo; Tetsu Ohwada, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/906,726

(22) Filed: Jul. 18, 2001

Related U.S. Application Data

(63) Continuation of application No. PCT/JP99/07029, filed on Dec. 15, 1999.

(51) Int. Cl.[7] ..... H01Q 1/50; H01Q 1/36

(52) U.S. Cl. ..... 343/860; 343/853; 343/895

(58) Field of Search ..... 343/700 MS, 850, 343/853, 860, 895, 862; 333/17.3, 32

(56) References Cited

U.S. PATENT DOCUMENTS 5,541,617 A * 7/1996 Connolly et al. ..... 343/895
5,828,348 A 10/1998 Tassoudji et al. ..... 343/895
5,838,285 A * 11/1998 Tay et al. ..... 343/895
5,872,549 A * 2/1999 Huynh et al. ..... 343/895
5,986,616 A * 11/1999 Edvardsson ..... 343/853
6,094,187 A * 7/2000 Sanford ..... 343/895
6,229,499 B1 * 5/2001 Licul et al. ..... 343/895

FOREIGN PATENT DOCUMENTS

| | | |
|---|---|---|
| JP | 5-041676 | 2/1993 |
| JP | 5-251910 | 9/1993 |
| JP | 10-098320 | 4/1998 |
| JP | 10-256824 | 9/1998 |
| JP | 10-308624 | 11/1998 |
| JP | 11-074720 | 3/1999 |

* cited by examiner

*Primary Examiner*—Tan Ho
(74) *Attorney, Agent, or Firm*—Oblon, Spivak, McClelland, Maier & Neustadt, P.C.

(57) ABSTRACT

An antenna device including matching circuits corresponding to reflection coefficients of antenna elements determined by taking into account the couplings between the antenna elements occurring when the antenna elements are excited with corresponding excitation amplitudes and excitation phases at each of operational frequencies.

10 Claims, 5 Drawing Sheets

ANTENNA DEVICE PROVIDED WITH MATCHING CIRCUITS ADAPTED FOR REFLECTION COEFFICIENTS

CROSS-REFERENCE TO THE RELATED APPLICATION

This application is a continuation of International application No. PCT/JP99/07029, whose international filing date is Dec. 15, 1999, the disclosures of which Application are incorporated by reference herein. The present application has not been published in English.

BACKGROUND OF THE INVENTION

1. Field of the Invention

The present invention generally relates to antenna devices and, more particularly, to an antenna device composed of a multi-element antenna, operated at a plurality of frequencies and provided with matching circuits adapted for reflection coefficients.

2. Description of the Related Art

FIG. 1 shows a construction of a conventional antenna device-disclosed, for example, in U.S. Pat. No. 5,828,348; this example is the case of a 4-element antenna operated at two frequencies, and matching circuits connected to the 4-element antenna are the same.

In FIG. 1, symbols 101*a*, 101*b*, 101*c* and 101*d* denote antenna elements, symbols 102*a*, 102*b*, 102*c* and 102*d* denote parasitic antenna elements, symbols 103*a*, 103*b*, 103*c* and 103*d* denote matching circuits connected respectively to the antenna elements 101*a*, 101*b*, 101*c* and 101*d*, symbols 104*a* and 104*b* denote divider/combiner circuits using double branch line circuits for dividing an inputted signal into two signals with a phase difference of 90 degrees, numeral 105 denotes a 180-degree divider/combiner circuit for dividing an inputted signal into two signals with a phase difference of 180 degrees, and numeral 106 denotes an input/output terminal.

FIG. 2 shows a cylindrical dielectric 30 on the surface of which an antenna portion composed of the antenna elements 101*a*, 101*b*, 101*c*, 101*d* and parasitic antenna elements 102*a*, 102*b*, 102*c*, 102*d* of FIG. 1 is provided. As shown in the figure, the antenna elements 101*a*, 101*b*, 101*c* and 101*d* are formed on the outer surface of the cylindrical dielectric 30, while the parasitic antenna elements 102*a*, 102*b*, 102*c* and 102*d* are formed on the inner surface of inside diameter of the cylindrical dielectric 30.

The operation of the antenna device will now be described.

A signal inputted to the input/output terminal 106 is divided by the 180-degree divider/combiner circuit 105 as signals having phases of 0 degree and −180 degrees. Thereafter, one of the signals is divided by the divider/combiner circuit 104*a* as signals having phases of 0 degree and −90 degrees, and the other is divided by the divider/combiner circuit 104*b* as signals having phases of −180 degrees and −270 degrees. At two operating frequencies f1 and f2, the 180-degree divider/combiner circuit 105 realizes a phase distribution of 0 degree and −180 degrees, while the divider/combiner circuits 104*a* and 104*b* realize a phase distribution of 0 degree and −90 degrees.

In order to realize matching for each of the antenna elements 101*a*, 101*b*, 101*c* and 101*d* at the two frequencies f1 and f2, a scattering matrix of the antenna is determined empirically or by calculation, and reflection coefficients in operation are determined using excitation amplitude and excitation phase. In this example, due to symmetry of the scattering matrix of the antenna and symmetry of the excitation phase, the reflection coefficients of the antenna elements 101*a*, 101*b*, 101*c* and 101*d* are equal. Accordingly, the matching circuits 103*a*, 103*b*, 103*c* and 103*d* connected respectively to the antenna elements 101*a*, 101*b*, 101*c* and 101*d* are the same.

The entire divider/combiner circuit composed of the 180-degree divider/combiner circuit 105 and the divider/combiner circuits 104*a* and 104*b* is large in size, as shown in FIG. 1. Thus, as shown in FIG. 2, the entire divider/combiner circuit cannot be formed on the cylindrical dielectric 30, and, therefore, only the antenna portion composed of the antenna elements 101*a*, 101*b*, 101*c*, 101*d* and the parasitic antenna elements 102*a*, 102*b*, 102*c*, 102*d* is formed on the cylindrical dielectric 30.

FIG. 3 shows a conventional small-type divider/combiner circuit constructed by combining T branches with lines of unequal lengths. In the figure, symbols 107*a*, 107*b*, 107*c* and 107*d* denote excitation terminals, numeral 108 denotes an input/output terminal, and symbols 109*a*, 109*b*, 109*c* and 109*d* denote lines having lengths according to desired excitation phases. The lengths of the lines are such that 109*a*<109*b*<109*c*<109*d*, and the excitation phase is progressively delayed in the order of 107*a*, 107*b*, 107*c* and 107*d*.

In the small-type divider/combiner circuit composed of T branches and lines of unequal lengths shown in FIG. 3, where the antenna device is operated at a plurality of frequencies, it is difficult to realize excitation with progressive phase shifts of a predetermined angle at all the frequencies. For example, where the lines 109*a*, 109*b*, 109*c* and 109*d* are set for excitation with symmetric phases by providing progressive phase shifts of 90 degrees at a frequency f1, the progressive phase shifts of 90 degrees cannot be achieved but asymmetric excitation results at a frequency f2 different from the frequency f1, and, therefore, the reflection coefficients at the antenna elements 101*a*, 101*b*, 101*c* and 101*d* are not equal to each other.

Since the conventional antenna devices are constituted as described above, there is the problem that the 180-degree divider/combiner circuit 105 and the divider/combiner circuits 104*a* and 104*b* for excitation with progressive phase shifts of a predetermined angle at operational frequencies f1 and f2 become very large, as shown in FIG. 1.

Therefore, where the antenna elements 101*a*, 101*b*, 101*c*, 101*d*, the matching circuits 103*a*, 103*b*, 103*c*, 103*d*, the divider/combiner circuits 104*a*, 104*b* and the 180-degree divider/combiner circuit 105 shown in FIG. 1 are formed on respective substrates and the substrates are connected to each other by cables or other connecting mechanisms, there is the problem that the antenna device as a whole becomes very large.

Besides, in the case of the small-type divider/combiner circuit composed of the T branches and the lines of unequal lengths shown in FIG. 3, there is a problem that it is difficult to achieve excitation with progressive phase shifts of a predetermined angle at both the operational frequencies f1 and f2, so that the reflection coefficients at the antenna elements 101*a*, 101*b*, 101*c* and 101*d* are not equal to each other, so that matching cannot be attained.

SUMMARY OF THE INVENTION

Accordingly, a general object of the present invention is to provide an antenna device in which the aforementioned disadvantages are eliminated.

Another and more specific object is to provide an antenna device which realizes smallness in size by using a small-type divider/combiner circuit such as the one shown in FIG. 3 and it is possible to attain matching of a multi-element antenna at a plurality of operational frequencies by connecting different matching circuits respectively to the antenna elements 101*a,* 101*b,* 101*c* and 101*d.*

Still another object of the invention is to obtain an antenna device which is reduced in overall size by integrally forming antenna elements, matching circuits and divider/combiner circuits on a cylindrical dielectric.

According to the present invention, there is provided an antenna device comprising a plurality of antenna elements operated at a plurality of frequencies, a divider/combiner circuit for exciting the plurality of antenna elements at desired phases, and matching circuits each connected to the antenna element at one end and connected to the divider/combiner circuit at the other end, the matching circuits corresponding to reflection coefficients of the antenna elements determined by taking into account the coupling between the antenna elements occurring when the antenna elements are excited with corresponding excitation amplitudes and excitation phases at each of the frequencies.

This is effective in that it is possible to attain impedance matching of each of the antenna elements at the plurality of operational frequencies.

According to the present invention, there is provided an antenna device wherein the divider/combiner circuit is constructed by combining T branches with different-length lines.

This is effective in that the antenna device can be made smaller in size.

According to the present invention, there is provided an antenna device wherein branch line circuits are used as the divider/combiner circuit.

This is effective in that the antenna device can be made smaller in size, and designing of the matching circuits can be easily realized.

According to the present invention, there is provided an antenna device wherein the plurality of antenna elements, the divider/combiner circuit and the matching circuits are integrally formed on a surface of a cylindrical dielectric.

This is effective in that the antenna device can be made smaller in size.

According to the present invention, there is provided an antenna device wherein parasitic antenna elements are disposed in the vicinity of said antenna elements.

This is effective in that a desired radiation pattern can be obtained from the antenna device.

According to the present invention, there is provided an antenna device wherein the plurality of antenna elements, the divider/combiner circuit and the matching circuits are integrally formed on a surface of a first cylindrical dielectric and the parasitic antenna elements are integrally formed on a surface of a second cylindrical dielectric different in inside diameter from the first cylindrical dielectric.

This is effective in that the antenna device can be made smaller in size.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENTS

Embodiment 1

Figure 1:
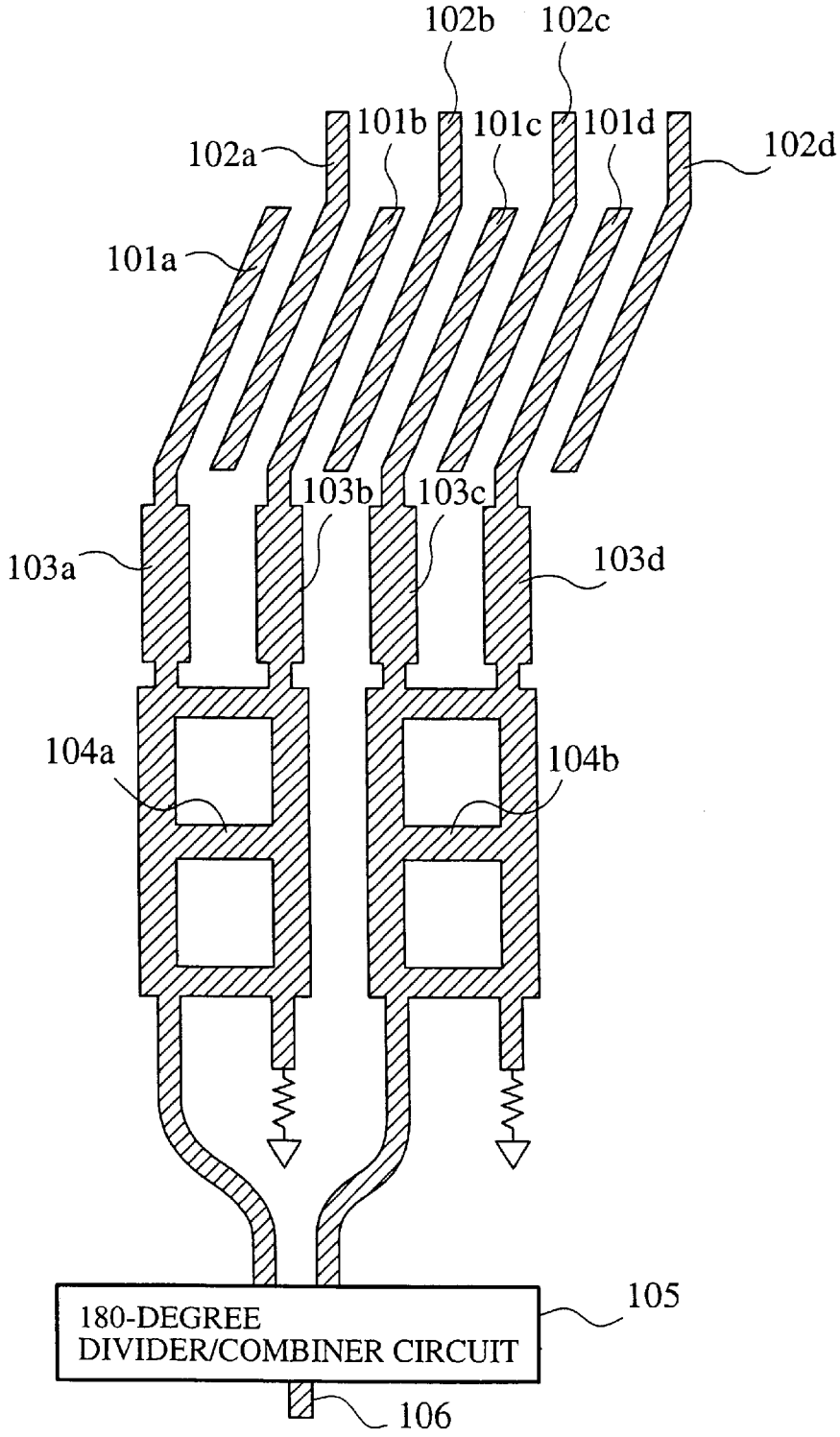
FIG.1 (PRIOR ART)
FIG. 1 is a development of an antenna device according to the prior art.
Figure 3:
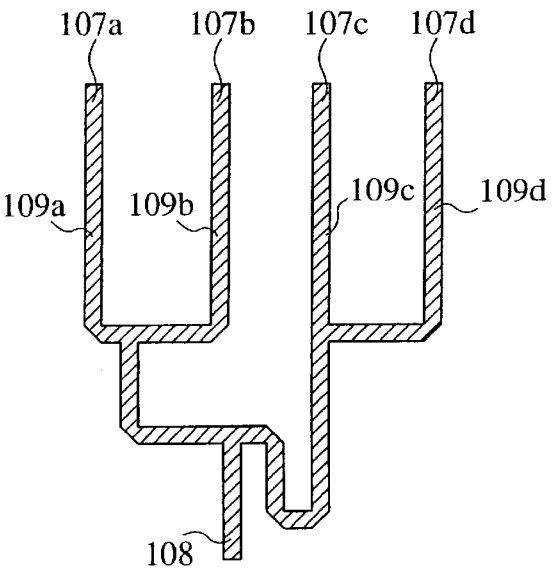
FIG.3 (PRIOR ART)
FIG. 3 shows a small-type divider/combiner circuit according to the prior art.
Figure 2:
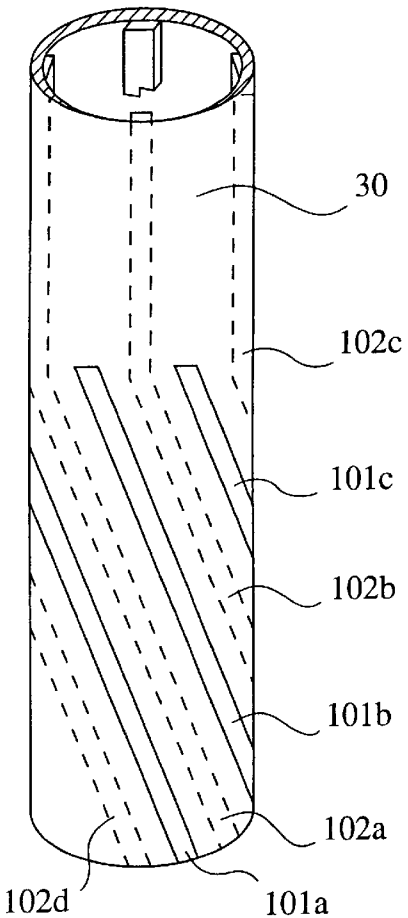
FIG.2 (PRIOR ART)
FIG. 2 shows a conventional cylindrical dielectric on which antenna elements are formed.
Figure 4:
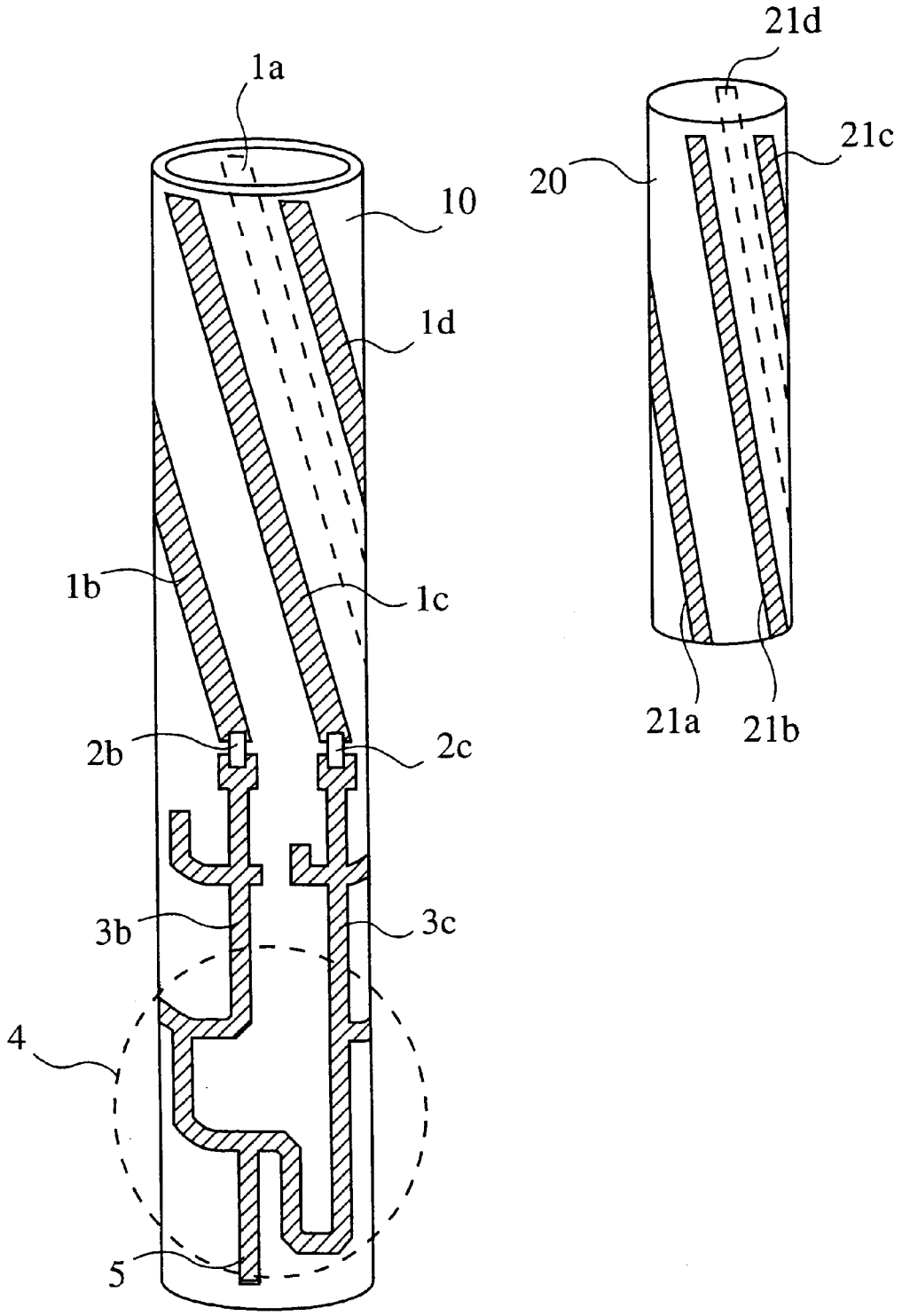
FIG. 4 shows the constitution of an antenna device according to Embodiment 1 of the present invention.
Figure 5:
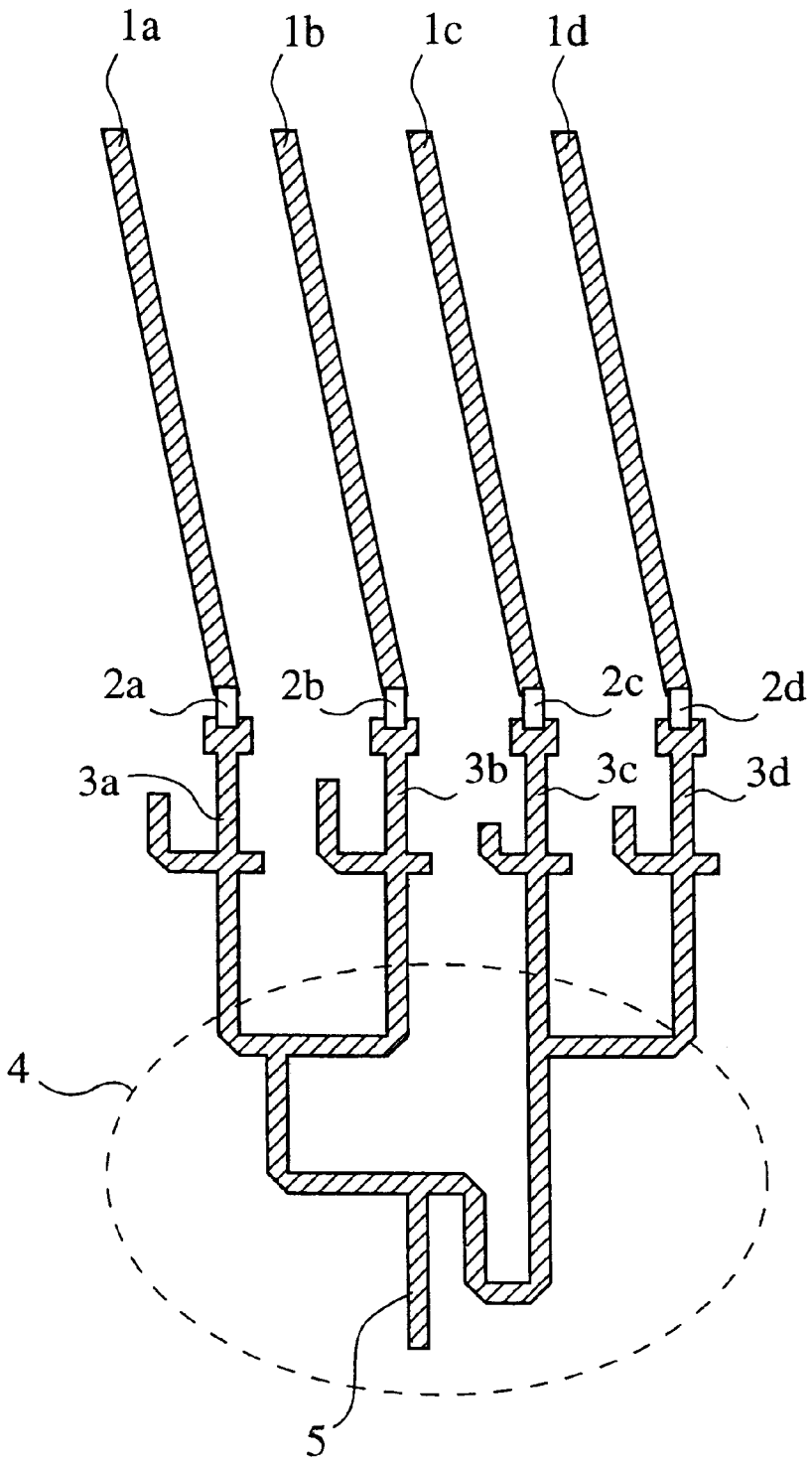
FIG. 5 is a development of the antenna device according to Embodiment 1 of the present invention.

FIG. 4 shows the constitution of an antenna device according to Embodiment 1 of the present invention, and FIG. 5 is a development of the antenna device of FIG. 4.

In FIGS. 4 and 5, symbols 1*a,* 1*b,* 1*c* and 1*d* denote antenna elements, symbols 2*a,* 2*b,* 2*c* and 2*d* denote capacitors, symbols 3*a,* 3*b,* 3*c* and 3*d* denote matching circuits, numeral 4 denotes a divider/combiner circuit, and numeral 5 denotes an input/output terminal.

The divider/combiner circuit 4 is composed of T branches and lines of unequal lengths, and is characterized by simple structure and small size. The line extending from the input/output terminal 5 is coupled to two routes at a T branch, and each of the two routes has a T branch; thus, a total of four routes are provided. The distances in the respective routes from the input/output terminal 5 to the antenna elements 1*a,* 1*b,* 1*c* and 1*d* generally differ from each other in units of ¼ of a wave length at a given frequency. The differences in line length cause the generation of phase differences of 0 degree, −90 degrees, −180 degrees and −270 degrees at the antenna elements 1*a,* 1*b,* 1*c* and 1*d.*

Where two frequencies are used in operation, it is difficult to attain phase differences of 0 degree, −90 degrees, −180 degrees and −270 degrees for both of the two frequencies f1 and f2. In this embodiment, therefore, the divider/combiner circuit 4 is so designed that excitation phases of 0 degree, −90 degree, −180 degree and −270 degree are obtained at the terminals on the side of the antenna elements 1*a,* 1*b,* 1*c* and 1*d* at one frequency f1 of the two operational frequencies.

In FIG. 4, numeral 10 denotes a cylindrical dielectric (first cylindrical dielectric), numeral 20 denotes a cylindrical dielectric (second cylindrical dielectric) smaller in inside diameter than the cylindrical dielectric 10, and symbols 21*a,* 21*b,* 21*c* and 21*d* denote parasitic antenna elements formed on the surface of the cylindrical dielectric 20.

A ground conductor is plated on a lower portion, outside the antenna elements 1*a,* 1*b,* 1*c* and 1*d,* of the inside of the cylindrical dielectric 10. No ground conductor is provided on a higher portion of the inside of the cylindrical dielectric 10 opposite the antenna elements 1*a,* 1*b,* 1*c* and 1*d.* The cylindrical dielectric 20 on which the parasitic antenna elements 21*a,* 21*b,* 21*c* and 21*d* are formed is so designed as to be fitted in the cylindrical dielectric 10. The cylindrical dielectric 20 is so disposed as to overlap a portion of the cylindrical dielectric 10 while in operation.

While the capacitors 2*a,* 2*b,* 2*c* and 2*d* are provided for matching in this embodiment, they can be omitted if characteristics provided by the capacitors 2*a,* 2*b,* 2*c* and 2*d* are included in the matching circuits 3*a,* 3*b,* 3*c* and 3*d.*

The operation of the antenna device will now be described.

Where the antenna elements 1*a,* 1*b,* 1*c* and 1*d* are arranged symmetrically, a scattering matrix as viewed from the terminals of the antenna elements 1*a,* 1*b,* 1*c* and 1*d* has a symmetric form given by the following Eq. 1.

$$S_{dd}=S_{bb}=S_{cc}=S_{aa}$$

$$S^{dc}=S_{cd}=S_{ba}=S_{ab}=S_{bc}=S_{cb}=S_{ad}=S_{da}$$

$$S_{ac}=S_{ca}=S_{db}=S_{bd}$$

Eq. 1

In the above Eq. 1, $S_{ij}$ (i =a to d, j =a to d) indicates a coupling coefficient between an antenna element j and an antenna element i, and $S_{ii}$ indicates a reflection coefficient of the antenna element i, wherein it is assumed that the antenna elements other than the antenna element i are terminated in a no-reflection state. These values are obtained by measurement or calculation in a state where the parasitic antenna elements 21*a,* 21*b,* 21*c* and 21*d* are fitted.

A scattering matrix of the divider/combiner circuit 4 is obtained by measurement or calculation as a scattering matrix composed of five terminals, that is, the input/output terminal 5 and the four terminals of the antenna elements 1*a,* 1*b,* 1*c* and 1*d.* By using the scattering matrix as viewed from the terminals of the antenna elements 1*a,* 1*b,* 1*c,* 1*d* and the scattering matrix of the divider/combiner circuit 4, there are obtained excitation amplitudes and excitation phases of the antenna elements 1*a,* 1*b,* 1*c* and 1*d* at the terminals of the antenna elements 1*a,* 1*b,* 1*c* and 1*d* in a state where the antenna elements 1*a,* 1*b,* 1*c* and 1*d* are connected to the divider/combiner circuit 4.

In FIG. 5, the divider/combiner circuit 4 is here so designed that signals having excitation phases of 0 degree, −90 degrees, −180 degrees, −270 degrees and the same excitation amplitude are obtained at the terminals of the antenna elements 1*a,* 1*b,* 1*c* and 1*d* at a given frequency f1. At this time, as given by the following Eq. 2, the reflection coefficients $\Gamma_a$, $\Gamma_b$, $\Gamma_c$ and $\Gamma_d$ of the antenna elements 1*a,* 1*b,* 1*c* and 1*d* determined by taking into account the coupling between the antenna elements 1*a,* 1*b,* 1*c* and 1*d* at the terminals of the antenna elements 1*a,* 1*b,* 1*c* and 1*d* have the same value $\Gamma_0$.

$$\Gamma_a = S_{aa} + S_{ab}\cdot e^{-j\frac{\pi}{2}} + S_{ac}\cdot e^{-j\pi} + S_{ad}\cdot e^{-j\frac{3\pi}{2}} \quad (2)$$

$$\Gamma_b = S_{bb} + S_{bc}\cdot e^{-j\frac{\pi}{2}} + S_{bd}\cdot e^{-j\pi} + S_{ba}\cdot e^{-j\frac{3\pi}{2}}$$

$$\Gamma_c = S_{cc} + S_{cd}\cdot e^{-j\frac{\pi}{2}} + S_{ca}\cdot e^{-j\pi} + S_{cb}\cdot e^{-j\frac{3\pi}{2}}$$

$$\Gamma_d = S_{dd} + S_{da}\cdot e^{-j\frac{\pi}{2}} + S_{db}\cdot e^{-j\pi} + S_{bc}\cdot e^{-j\frac{3\pi}{2}}$$

Eq. 2

In contrast, at a frequency f2 different from the frequency f1, the excitation phases at the terminals of the antenna elements 1*a,* 1*b,* 1*c* and 1*d* are not equal to 0 degree, −90 degrees, −180 degrees and −270 degrees, but have slightly deviated values. Assuming the excitation phases to be p1 degrees, p2 degrees, p3 degrees and p4 degrees and assuming the excitation amplitudes to be M1, M2, M3 and M4, the reflection coefficients $\Gamma_1$, $\Gamma_2$, $\Gamma_3$ and $r_4$ determined by taking into account the coupling of the antenna elements 1*a,* 1*b,* 1*c* and 1*d* at the terminals of the antenna elements 1*a,* 1*b,* 1*c* and 1*d* have different values given by the following Eq. 3.

$$\Gamma_1=(S_{aa}\cdot M_1e^{jP}1+S_{ab}\cdot M_2e^{jP}2+S_{ac}\cdot M_3e^{jP}3+S_{ad}\cdot M_4e^{jP}4)/\ M_1e^{jP}1 \quad (3)$$

$$\Gamma_2=(S_{ba}\cdot M_1e^{jP}1+S_{bb}\cdot M_2e^{jP}2+S_{bc}\cdot M_3e^{jP}3+S_{bd}\cdot M_4e^{jP}4)/\ M_2e^{jP}2$$

$$\Gamma_3=(S_{ca}\cdot M_1e^{jP}1+S_{cb}\cdot M_2e^{jP}2+S_{cc}\cdot M_3e^{jP}3+S_{cd}\cdot M_4e^{jP}4)/\ M_3e^{jP}3$$

$$\Gamma_4=(S_{da}\cdot M_1e^{jP}1+S_{db}\cdot M_2e^{jP}2+S_{dc}\cdot M_3e^{jP}3+S_{dd}\cdot M_4e^{jP}4)/\ M_4e^{jP}4$$

Eq. 3

The matching circuits 3*a,* 3*b,* 3*c* and 3*d* are so sized as to match the reflection coefficient $\Gamma_0$ of the antenna elements 1*a,* 1*b,* 1*c* and 1*d* given by Eq. 2 above at the frequency f1, and to match the reflection coefficients $\Gamma_1$, $\Gamma_2$, $\Gamma_3$ and $\Gamma_4$ of the antenna elements 1*a,* 1*b,* 1*c* and 1*d* give by Eq. 3 at the frequency f2. Therefore, the matching circuits 3*a,* 3*b,* 3*c* and 3*d* differ in size.

The excitation amplitudes and the excitation phases of the antenna elements 1*a,* 1*b,* 1*c* and 1*d* obtained by the above calculation have values somewhat deviated from the initial values, due to the connection of the differently-sized matching circuits 3*a,* 3*b,* 3*c* and 3*d.* Taking into account the characteristics of the matching circuits 3*a,* 3*b,* 3*c* and 3*d* connected, excitation amplitudes and excitation phases of the antenna elements 1*a,* 1*b,* 1*c* and 1*d* are newly calculated, and the matching circuits 3*a,* 3*b,* 3*c* and 3*d* are redesigned using the newly obtained excitation amplitudes and excitation phases. This process is repeated, so as to accomplish more accurate designing.

By designing the sizes of the matching circuits 3*a,* 3*b,* 3*c* and 3*d* to match the different reflection coefficients of the antenna elements 1*a,* 1*b,* 1*c* and 1*d* in the manner as described above, it is possible to realize an antenna device having excellent characteristics even when a divider/combiner circuit 4 incapable of realizing the excitation phases of 0 degree, −90 degree, −180 degree and −270 degree at the two frequencies f1 and f2 is used.

Besides, by using the divider/combiner circuit 4 which is simple in structure and small in size, it is possible to integrally form the antenna elements 1*a,* 1*b,* 1*c,* 1*d,* the capacitors 2*a,* 2*b,* 2*c,* 2*d,* the matching circuits 3*a,* 3*b,* 3*c,* 3*d* and the divider/combiner circuit 4 on the cylindrical dielectric 10.

Furthermore, the cylindrical dielectric 20 is so disposed as to overlap a portion of the cylindrical dielectric 10 while in operation and the parasitic antenna elements 21*a,* 21*b,* 21*c* and 21*d* are disposed in the vicinity of the antenna elements 1*a,* 1*b,* 1*c* and 1*d,* so that a desired radiation pattern can be radiated from the antenna device.

While two operational frequencies are used in this embodiment, three or more frequencies may be adopted. In addition, while four antenna elements are used in this embodiment, the requirement is that at least two antenna elements are used. Further, while four parasitic antenna elements are used in this embodiment, the requirement is that at least two parasitic antenna elements are used.

Besides, while the divider/combiner circuit 4 in this embodiment is so designed that the same excitation amplitude and the excitation phases of 0 degree, −90 degree, −180 degrees and −270 degrees are realized at the terminals on the side of the antenna elements 1*a,* 1*b,* 1*c* and 1*d* at the frequency f1 and that different excitation amplitudes and different excitation phases are realized at the frequency f2, the divider/combiner circuit 4 may also be so designed that different excitation amplitudes and excitation phases as close as possible to 0 degree, −90 degrees, −180 degrees and −270 degrees are realized at both of frequencies f1 and f2.

While the parasitic antenna elements 21*a,* 21*b,* 21*c* and 21*d* are integrally formed on the cylindrical dielectric 20 smaller in inside diameter than the cylindrical dielectric 10 and the cylindrical dielectric 20 is inserted in the cylindrical dielectric 10 in this embodiment, the parasitic antenna elements 21*a,* 21*b,* 21*c* and 21*d* may be integrally formed on a cylindrical dielectric 20 larger in inside diameter than the cylindrical dielectric 10 so that the cylindrical dielectric 10 can be inserted in the cylindrical dielectric 20. In addition, the parasitic antenna elements 21*a*, 21*b*, 21*c* and 21*d* may be integrally formed on the inner surface of the cylindrical dielectric 10, instead of using the cylindrical dielectric 20, as long as the height of the cylindrical dielectric 10 is maintained.

As described above, according to this Embodiment 1, the matching circuits 3*a*, 3*b*, 3*c* and 3*d* are made to correspond to the reflection coefficients of the antenna elements 1*a*, 1*b*, 1*c* and 1*d* determined by taking into account the coupling between the antenna elements 1*a*, 1*b*, 1*c* and 1*d* occurring when the antenna elements 1*a*, 1*b*, 1*c* and 1*d* are excited according to the corresponding excitation amplitudes and excitation phases at operational frequencies, so that the impedance matching can be attained.

In addition, according to this Embodiment 1, the divider/combiner circuit 4 is composed of T branches and lines of unequal lengths simple in structure and small in size, so that the antenna device can be made smaller in size.

Further, according to this Embodiment 1, a plurality of antenna elements 1*a*, 1*b*, 1*c*, 1*d*, the divider/combiner circuit 4 and the matching circuits 3*a*, 3*b*, 3*c*, 3*d* are integrally formed on the surface of the cylindrical dielectric 10, so that the antenna device can be made smaller in size.

Furthermore, according to this Embodiment 1, the parasitic antenna elements 21*a*, 21*b*, 21*c* and 21*d* are disposed in the vicinity of the antenna elements 1*a*, 1*b*, 1*c* and 1*d* at the time of operation, so that a desired radiation pattern can be radiated from the antenna device.

Furthermore, according to this Embodiment 1, the parasitic antenna elements 21*a*, 21*b*, 21*c* and 21*d* are integrally formed on the surface of the cylindrical dielectric 20 different in inside diameter from the cylindrical dielectric 10, so that the device can be made smaller in size.

Embodiment 2

Figure 6:
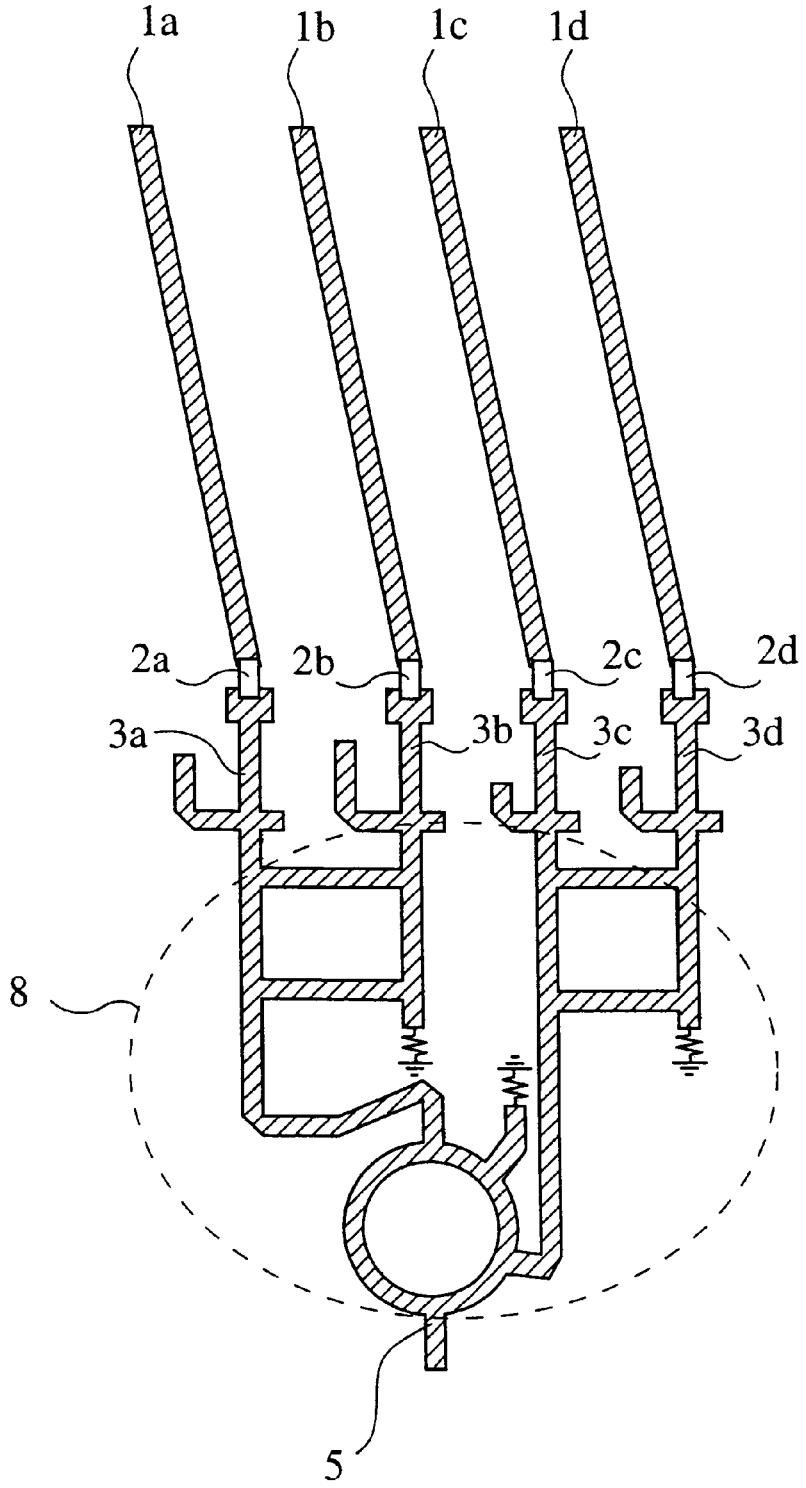
FIG. 6 is a development of an antenna device according to Embodiment 2 of the present invention.

FIG. 6 is a development of an antenna device according to Embodiment 2 of the present invention. In this embodiment, the divider/combiner circuit 4 in Embodiment 1 is replaced by a divider/combiner circuit using branch line circuits.

In FIG. 6, symbols 1*a*, 1*b*, 1*c* and 1*d* denote antenna elements, symbols 2*a*, 2*b*, 2*c* and 2*d* denote capacitors, symbols 3*a*, 3*b*, 3*c* and 3*d* denote matching circuits, numeral 8 denotes a divider/combiner circuit using branch line circuits, and numeral 5 denotes a signal input/output terminal.

The divider/combiner circuit 8 is larger than the divider/combiner circuit 4 composed of T branches and lines of unequal lengths in Embodiment 1, but is smaller than that using the divider/combiner circuits 104*a*, 104*b*, using the double branch circuits, and the 180-degree divider/combiner circuit 105 according to the prior art. In the divider/combiner circuit 8, a loop line connected to the input/output terminal 5 gives a phase difference of 180 degrees, and the subsequent lines give phase differences of 90 degrees.

Where two operational frequencies are used, it is difficult to realize phase differences of 0 degree, −90 degrees, −180 degrees and −270 degrees at both of the frequencies f1 and f2; in this embodiment, therefore, the divider/combiner circuit 8 is so designed that excitation phases of 0 degree, −90 degrees, −180 degrees and −270 degrees are attained at terminals on the side of the antenna elements 1*a*, 1*b*, and 1*d* at one frequency f1 of the two operational frequencies.

The operation of the antenna device will now be described.

Where the antenna elements 1*a*, 1*b*, 1*c* and 1*d* are disposed symmetrically, the scattering matrix as viewed from the terminals of the antenna elements 1*a*, 1*b*, and 1*d* assumes a symmetric form as shown in Eq. 1 above. In FIG. 6, the divider/combiner circuit 8 here is so designed that signals having excitation phases of 0 degree, −90 degrees, −180 degrees and −270 degrees and the same excitation amplitude are obtained at the terminals on the side of the antenna elements 1*a*, 1*b*, 1*c* and 1*d* at a certain frequency f1. In this case, from Eq. 2 above, the reflection coefficients $\Gamma_a$, $\Gamma_b$,$\Gamma_{c4}$ , and $\Gamma_d$ of the antenna elements 1*a*, 1*b*, 1*c* and 1*d* determined by taking into account the coupling between the antenna elements 1*a*, 1*b*, 1*c* and 1*d* at the terminals of the antenna elements 1*a*, 1*b*, 1*c* and 1*d* have the same value $\Gamma_0$.

In contrast, at a frequency f2 different from the frequency f1, the excitation phases at the terminals of the antenna elements 1*a*, 1*b*, 1*c* and 1*d* are generally not 0 degree, −90 degrees, −180 degrees and −270 degrees but have slightly deviated values. Assuming the actual excitation phases to be p1 degrees, p2 degrees, p3 degrees and p4 degrees and the excitation amplitudes to be M1, M2, M3 and M4, the reflection coefficients $\Gamma_1$, $\Gamma_2$, $\Gamma_3$ and $\Gamma_4$ determined by taking into account the couplings between the antenna elements 1*a*, 1*b*, 1*c* and 1*d* at the terminals of the antenna elements 1*a*, 1*b*, 1*c* and 1*d* have different values as given by Eq. 3 above.

The matching circuits 3*a*, 3*b*, 3*c* and 3*d* are so designed as to match the reflection coefficients $\Gamma_0$ of the antenna elements 1*a*, 1*b*, 1*c* and 1*d* given by Eq. 2 above at the frequency f1 and to match the reflection coefficients $\Gamma_1$, $\Gamma_2$, $\Gamma_3$ and $\Gamma_4$ of the antenna elements 1*a*, 1*b*, 1*c* and 1*d* given by Eq. 3 above at the frequency f2. Accordingly, the matching circuits 3*a*, 3*b*, 3*c* and 3*d* are different in size.

The operation of this embodiment is generally the same as the operation of Embodiment 1, but is characterized in that, since the divider/combiner circuit 8 is composed using the branch line circuits, the excitation phases of the antenna elements 1*a*, 1*b*, 1*c* and 1*d* at the two frequencies f1 and f2 are not seriously deviated from 0 degree, −90 degrees, −180 degrees and −270 degrees, so that the matching circuits 3*a*, 3*b*, 3*c* and 3*d* differ only slightly from each other and it is easy to design the matching circuits 3*a*, 3*b*, 3*c* and 3*d*.

In this manner the sizes of the matching circuits 3*a*, 3*b*, 3*c* and 3*d* are designed so as to correspond to the different reflection coefficients of the terminals of the antenna elements 1*a*, 1*b*, 1*c* and 1*d*, so that an antenna device having excellent characteristics can be realized even when a divider/combiner circuit 8 which cannot necessarily realize the excitation phases of 0 degree, −90 degrees, −180 degrees and −270 degrees at the two frequencies f1 and f2 is used.

In addition, the use of the small type divider/combiner circuit 8 makes it possible to integrally form the antenna elements 1*a*, 1*b*, 1*c*, 1*d* , the capacitors 2*a*, 2*b*, 2*c*, 2*d*, the matching circuits 3*a*, 3*b*, 3*c*, 3*d* and the divider/combiner circuit 8 on the cylindrical dielectric 10.

Further, the cylindrical dielectric 20 is so disposed while in operation as to overlap a portion of the cylindrical dielectric 10 and the parasitic antenna elements 21*a*, 21*b*, 21*c* and 21*d* are disposed in the vicinity of the antenna elements 1*a*, 1*b*, 1*c* and 1*d*, so that a desired radiation pattern can be radiated from the antenna device.

While two operational frequencies are used in this embodiment, the requirement is that at least two frequencies are used. Besides, while four antenna elements are used in this embodiment, the requirement is that at least two antennal elements are used. Further, while four parasitic antenna elements are used in this embodiment, the requirement is that one or a plurality of parasitic antennas are used.

While the divider/combiner circuit 8 in this embodiment is so designed that the same excitation amplitude and excitation phases of 0 degree, −90 degrees, −180 degrees and −270 degrees are obtained at the terminals of the antenna elements 1*a*, 1*b*, 1cand 1*d* at the frequency f1 and that different excitation amplitudes and different excitation phases are obtained at the frequency f2, the divider/combiner circuit 8 may be so designed that different excitation amplitudes and excitation phases as close as possible to 0 degree, −90 degrees, −180 degrees and −270 degrees are obtained at both of the two frequencies f1 and f2.

While the parasitic antenna elements 21*a*, 21*b*, 21*c* and 21*d* are integrally formed on the cylindrical dielectric 20 smaller in inside diameter than the cylindrical dielectric 10 and the cylindrical dielectric 20 is inserted in the cylindrical dielectric 10 in this embodiment, the parasitic antenna elements 21*a*, 21*b*, 21*c* and 21*d* may be integrally formed on a cylindrical dielectric 20 larger in inside diameter than the cylindrical dielectric 10 so that the cylindrical dielectric 10 can be inserted in the cylindrical dielectric 20. Besides, the parasitic antenna elements 21*a*, 21*b*, 21*c* and 21*d* may be integrally formed on the inner surface of the cylindrical dielectric 10, instead of using the cylindrical dielectric 20, as long as the height of the cylindrical dielectric 10 is maintained.

As described above, according to this Embodiment 2, the matching circuits 3*a*, 3*b*, 3*c* and 3*d* are designed to correspond to the reflection coefficients of the antenna elements 1*a*, 1*b*, 1*c* and 1*d* determined by taking into account the coupling between the antenna elements 1*a*, 1*b*, 1*c* and 1*d* occurring when the antenna elements 1*a*, 1*b*, 1*c* and 1*d* are excited with corresponding excitation amplitudes and excitation phases, so that impedance matching can be attained.

In addition, according to this Embodiment 2, the branch line circuits are used as the divider/combiner circuit 8, so that the antenna device can be made smaller in size.

Further, according to this Embodiment 2, a plurality of antenna elements 1*a*, 1*b*, 1*c*, 1*d*, the divider/combiner circuit 8 and the matching circuits 3*a*, 3*b*, 3*c*, 3*d* are integrally formed on the surface of the cylindrical dielectric 10, so that the antenna device can be made smaller in size.

Furthermore, according to this Embodiment 2, the parasitic antenna elements 21*a*, 21*b*, 21*c* and 21*d* are disposed in the vicinity of the antenna elements 1*a*, 1*b*, 1*c* and 1*d* at the time of operation, so that a desired radiation pattern can be radiated from the antenna device.

Furthermore, according to this Embodiment 2, the parasitic antenna elements 21*a*, 21*b*, 21*c* and 21*d* are integrally formed on the surface of the cylindrical dielectric 20 different from the cylindrical dielectric 10 in inside diameter, so that the antenna device can be made smaller in size.

As has been described above, the antenna device according to the present invention comprises matching circuits corresponding to antenna elements and is thereby suitable for reduction in size.

The present invention is not limited to the above-described embodiments, and variations and modifications may be made without departing from the scope of the present invention.

What is claimed is:

1. An antenna device comprising:

a plurality of antenna elements operated at a plurality of frequencies, a divider/combiner circuit for effectively exciting said plurality of antenna elements at phases deviated from desired phases at a secondary frequency as well as at desired phases at a first frequency, and matching circuits each connected to said antenna element at one end and connected to said divider/combiner circuit at the other end, said matching circuits configured to differ in size to match reflection coefficients of said antenna elements determined by taking into account the coupling between said antenna elements occurring when said antenna elements are excited with corresponding excitation amplitudes and excitation phases at each of said frequencies.

2. The antenna device according to claim 1, wherein said divider/combiner circuit is constructed by combining T branches with lines of unequal lengths.

3. The antenna device according to claim 1, wherein branch line circuits are used as said divider/combiner circuit.

4. The antenna device according to claim 1, wherein said plurality of antenna elements, said divider/combiner circuit and said matching circuits are integrally formed on a surface of a cylindrical dielectric.

5. The antenna device according to claim 1, wherein parasitic antenna elements are disposed in the vicinity of said antenna elements.

6. The antenna device according to claim 5, wherein said plurality of antenna elements, said divider/combiner circuit and said matching circuits are integrally formed on a surface of a first cylindrical dielectric and said parasitic antenna elements are integrally formed on a surface of a second cylindrical dielectric different in inside diameter from said first cylindrical dielectric.

7. An antenna device comprising:

a plurality of antenna elements operated at a plurality of frequencies, a divider/combiner circuit for exciting said plurality of antenna elements at desired phases, and matching circuits each connected to said antenna element at one end and connected to said divider/combiner circuit at the other end, said matching circuits corresponding to reflection coefficients of said antenna elements determined by taking into account the coupling between said antenna elements occurring when said antenna elements are excited with corresponding excitation amplitudes and excitation phases at each of said frequencies, wherein parasitic antenna elements are disposed in the vicinity of said antenna elements, and wherein said plurality of antenna elements, said divider/combiner circuit and said matching circuits are integrally formed on a surface of a first cylindrical dielectric and said parasitic antenna elements are integrally formed on a surface of a second cylindrical dielectric different in inside diameter from said first cylindrical dielectric.

8. The antenna device according to claim 7, wherein said divider/combiner circuit is constructed by combining T branches with lines of unequal lengths.

9. The antenna device according to claim 7, wherein branch line circuits are used as said divider/combiner circuit.

10. The antenna device according to claim 7, wherein said plurality of antenna elements, said divider/combiner circuit and said matching circuits are integrally formed on a surface of a cylindrical dielectric.

* * * * *